US007652226B2

(12) United States Patent
Muromachi et al.

(10) Patent No.: US 7,652,226 B2
(45) Date of Patent: Jan. 26, 2010

(54) ELECTRICALLY HEATED WINDOW GLASS

(75) Inventors: Takashi Muromachi, Minato-ku (JP); Harunori Murakami, Minato-ku (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 284 days.

(21) Appl. No.: 10/579,180

(22) PCT Filed: Nov. 12, 2004

(86) PCT No.: PCT/JP2004/016861

§ 371 (c)(1),
(2), (4) Date: Apr. 19, 2007

(87) PCT Pub. No.: WO2005/048657

PCT Pub. Date: May 26, 2005

(65) Prior Publication Data

US 2007/0278200 A1 Dec. 6, 2007

(30) Foreign Application Priority Data

Nov. 14, 2003 (JP) ..... 2003-384660

(51) Int. Cl.
*H05B 3/00* (2006.01)
*H05B 3/34* (2006.01)

(52) U.S. Cl. ..... 219/203; 219/211; 219/212; 219/213; 219/528; 219/529

(58) Field of Classification Search ..... 219/202–3, 219/211–12, 213, 528, 529
See application file for complete search history.

(56) References Cited

FOREIGN PATENT DOCUMENTS

| | | |
|---|---|---|
| BE | 662 903 | 10/1965 |
| DE | 21 65 336 | 7/1973 |
| DE | 27 07 008 | 8/1978 |
| FR | 2 442 152 | 6/1980 |
| JP | 05-84547 | 11/1993 |
| JP | 6-302375 A | 10/1994 |
| JP | 7-17363 A | 1/1995 |
| JP | 7-309210 A | 11/1995 |

(Continued)

OTHER PUBLICATIONS

Supplementary European Search Report corresponding to Application No. EP 04 81 8520 dated Dec. 20, 2006.

(Continued)

*Primary Examiner*—Shawntina Fuqua
(74) *Attorney, Agent, or Firm*—RatnerPrestia

(57) ABSTRACT

An electrically heated window glass is provided, in which an electric power load may be suppressed by causing a consumed electric power for energizing a heater to be variable depending on the purpose of heating. The electrically heated window glass in accordance with the present invention comprises two glass panels laminated to each other; a plurality of heaters sandwiched between the two glass panels for heating the glass panels, the heaters being positioned in such a manner that the heaters divide the surface of the laminated glass panels into plural parts; a plurality bus bars each provided at the end portions of each of the plurality of heaters for feeding thereto; and a changeover means for switching the connection between selected one of the plurality of bus bars and a DC power supply to heat the plurality of heaters in a series connected manner or parallel connected manner.

8 Claims, 5 Drawing Sheets

FOREIGN PATENT DOCUMENTS

| | | | |
|---|---|---|---|
| JP | 8-119065 | | 5/1996 |
| JP | 8119065 | * | 5/1996 |
| JP | 2002-264780 A | | 9/2002 |
| JP | 2002264780 | * | 9/2002 |

OTHER PUBLICATIONS

International Search Report Feb. 1, 2005 PCT/JP2004/016861.

* cited by examiner

FIG. 3

| Electric Power (W) | Cuurrent (A) at 13V | Resistance (Ω/□) |
|---|---|---|
| 700 | 53.8 | 0.2 |
| 500 | 38.5 | 0.3 |
| 400 | 30.8 | 0.4 |
| 300 | 23.1 | 0.6 |

| | Electric Power for Frost (W) | Electric Power for Fog (W) |
|---|---|---|
| at 14V | 579.9 | 145.0 |
| at 13V | 500.0 | 125.0 |
| at 12V | 426.0 | 106.5 |

ELECTRICALLY HEATED WINDOW GLASS

TECHNICAL FIELD

The present invention relates to an electrically heated window glass, particularly to an electrically heated window glass used for a windshield of vehicles, which may remove ice, frost and the like adhered thereon by melting them due to an electrical heating.

BACKGROUND ART

An electrically heated window glass used for a windshield of vehicles has been conventionally known. The electrically heated window glass is formed by laminating two glass panels with sandwiching a heater therebetween, for example.

The electrically heated windshield may be heated by energizing the heater by means of a battery or the like, so that ice, frost, snow and the like adhered on the outside surface thereof may be melted. The inside surface of the windshield may also keep off fog thereon by heating. As a result, a filed of view may be secured in the windshield without being disturbed from ice, frost, snow and the like adhered on the outside surface, or fog caused on the inside surface thereof.

Such electrically heated window glass has been disclosed in Japanese Patent Publication No. 8-119065, for example. The electrically heated window glass disclosed in the publication comprises a transparent electrical conductive film and a pair of bus bars (i.e., electrodes for energizing) on top and bottom sides, or right and left sides thereof between two glass panels, in which the transparent electrical conductive film is energized via the bus bars by a battery or the like to heat the window glass for melting ice and snow, or defogging However, in the case of the electrically heated windshield heated by energizing the heater, a consumptive electric power capacity of the heater must be larger than 500W in order to melt ice and the like on the outside surface of the windshield. On the other hand, such large consumptive electric power capacity required to melt ice and the like is unnecessary for defogging the inside surface of the windshield. Furthermore, the heater must be used at a lower consumptive electric power capacity for decreasing a load to the battery due to a frequent usage thereof for defogging.

When the heater energized by a battery or the like is excessively heated, an optical distortion is caused in the glass panels sandwiching the heater, and the material for constituting the heater is degraded. In order to prevent these phenomena, dedicated terminals are required for detecting an excessive heating of the glass panels sandwiching the heater.

DISCLOSURE OF THE INVENTION

An object of the present is to provide an electrically heated window glass in which an electric power load may be suppressed by causing a consumed electric power for energizing a heater to be variable depending on the purpose of heating.

Another object of the present invention is to provide an electrically heated window glass which does not require dedicated terminals for detecting an excessive heating of glass panels due to a heater abnormality.

In order to achieve the object of the present invention, an electrically heated window glass in accordance with the present invention comprises two glass panels laminated to each other; a plurality of heaters sandwiched between the two glass panels for heating the glass panels, the heaters being positioned in such a manner that the heaters divide the surface of the laminated glass panels into plural parts; a plurality bus bars each provided at the end portions of each of the plurality of heaters for feeding thereto; and a changeover means for switching the connection between selected one of the plurality of bus bars and a DC power supply to heat the plurality of heaters in a series connected manner or parallel connected manner. The electrically heated window glass further comprises a current detecting circuit for separately detecting a current through each of the plurality of bus bars to obtain a condition representing no breakage of the laminated two glass panels from resistances between bus bars based on detected current values to sense an excessive heating of the laminated glass panels.

According to the structure described above, a plurality of heaters for heating the laminated two glass panels are positioned so that the heaters divide the surface of the laminated glass panels into plural parts, and a changeover means switches the connection between selected one of the plurality of bus bars and DC power supply to heat the plurality of heaters in a series connected manner or parallel connected manner, thereby each heater is energized by the plurality of bus bars arranged on the periphery of each heater. Also, a current detecting circuit separately detects current through each bus bar to obtain a condition representing no breakage of the laminated two glass panels from resistances between bus bars based on detected current values to sense an excessive heating of the laminated two glass panels.

BRIEF DESCRIPTION OF DRAWINGS

FIG. 3 is a table for showing the current supplied to the heaters and the electric power for removing frost by heating.

BEST MODE FOR CARRYING OUT THE INVENTION

A preferred embodiment will now be described with reference to drawings.

Figure 1:
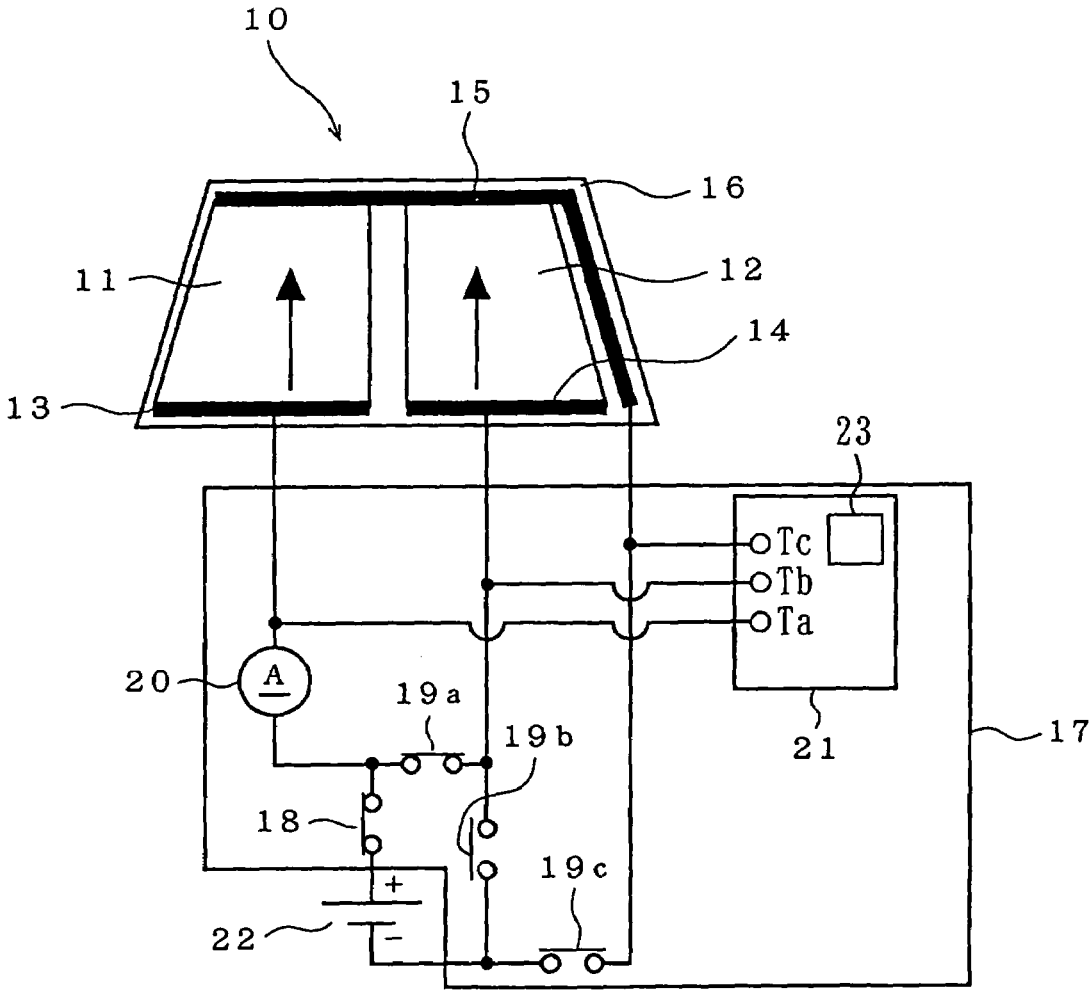
FIG. 1 is an explanatory view for showing an electrically heated windshield according to one embodiment of the present invention, and a schematic structure of an operating circuit thereof.

Referring to FIG. 1, there is shown an explanatory view for showing an electrically heated windshield (i.e., an electrically heated window glass) according to one embodiment of the present invention, and a schematic structure of an operating circuit thereof. As shown in FIG. 1, an electrically heated windshield 10 comprises two heaters 11 and 12 incorporated therein and three bus bars (i.e., electrodes for energizing) 13, 14 and 15, which is used for a windshield for vehicles as an example.

The electrically heated windshield 10 has a substantial trapezoid shape including a shorter upper edge and longer lower edge, which is formed by laminating two glass panels 16 (one of them is shown in the figure) with heaters 11 and 12 being sandwiched therebetween. Two heaters 11 and 12 which have a substantial trapezoid shape, respectively, and are arranged on right and left sides symmetrically with respect to the center line which divides the windshield 10 laterally into two parts, all area of the windshield being substantially occupied by the heaters. The heaters 11 and 12 are formed by a wire heater, a planar heater, or the like.

Each of three bus bars 13, 14 and 15 consists of an electrical conductive strip. The bus bar 13 is positioned at the lower edge of the heater 11, the bus bar 14 is positioned at the lower edge of the heater 12, and the bus bar 15 is positioned extending from the upper edges of the heaters 11 and 12 to the right side of the bus bar 14 along the side edge of the heater 12. In this manner, the three bus bars 13, 14 and 15 are arranged at three portions along the edge of the windshield. The bus bar 15 electrically connects the heaters 11 and 12.

Each bus bar 13, 14 or 15 is connected to a switching/detecting circuit 17 which comprises four relay contacts 18, 19*a*, 19*b* and 19*c*, a DC ammeter 20, and a controller box 21. One terminal of the relay contact 18 is connected to the bus bar 13 through the DC ammeter 20, and the other terminal thereof to the + terminal of an external DC power supply 22. One terminal of the relay contact 19*a* is connected to the bus bar 13 through the DC ammeter 20, and the other terminal thereof to the bus bar 14. One terminal of the relay contact 19*b* is connected to the bus bar 14, and the other terminal thereof to the − terminal of the external DC power supply 22. One terminal of the relay contact 19*c* is connected to the bus bar 15, and the other terminal thereof to the − terminal of the external DC power supply 22.

Depending upon the opening or closing of each of the relay 18, 19*a*, 19*b* and 19*c*, the + terminal of the external DC power supply 22 is connected to the bus bar 13, the − terminal thereof to the bus bar 15, and the + or − terminal thereof selectively to the bus bar 14. Therefore, the heaters 11 and 12 may be heated in a series connected manner or a parallel connected manner through any of three bus bars 13, 14 and 15. Each of relay contacts 18, 19*a*, 19*b* and 19*c* functions as a changeover means for connecting/switching between selected one of three bus bars 13, 14 and 15 and the external DC power supply 22.

Therefore, ice and frost adhered on the outside surface of the electrically heated windshield 10 may be removed by heating the heater 11 and 12 in a parallel connected manner, or fog on the inside surface of the windshield 10 may be removed by heating the heater 11 and 12 in a series connected manner.

In the controller box 21, there is provided a circuit 23 for preventing an excessive heating due to a breakage of the windshield. The circuit 23 detects a current through each of bus bars 13, 14 and 15, respectively, by means of a detecting terminal Ta connected to the bus bar 13, a detecting terminal Tb connected to the bus bar 14, and a detecting terminal Tc connected to the bus bar 15.

Assuming that the resistance between the bus bars 13 and 14 is Rab, the resistance between the bus bars 13 and 15 is Rac, and the resistance between the bus bars 14 and 15 is Rbc, if the relationship Rab= Rac+ Rbc is established on the basis of current measured values on the detecting terminals Ta, Tb and Tc, then it may be understood that there is no breakage in the windshield. In this manner, the condition representing no breakage of windshield may be obtained from the relationship of the resistances between bus bars to detect an excess heating of the surface of the glass panels.

In case of removing ice, frost and the like adhered on the outside surface of the windshield 10, the relay contacts 18, 19*a* and 19*c* are closed (ON state), and the relay contact 19*b* is opened (OFF state) as shown in FIG. 1. The bus bar 13 and 14 are caused to be + potential by turning ON the relay contacts 18 and 19*a*, and the bus bar 15 is caused to be − potential by turning ON the relay contact 19*c*. Thus, a DC current flows from the bus bar 13 and 14 to the bus bar 15 as shown by arrows to heat the heaters 11 and 12 in a parallel connected manner. As a result, the windshield 10 may be heated by the two heaters to melt ice and frost adhered on the outside surface of the windshield 10.

Figure 2:
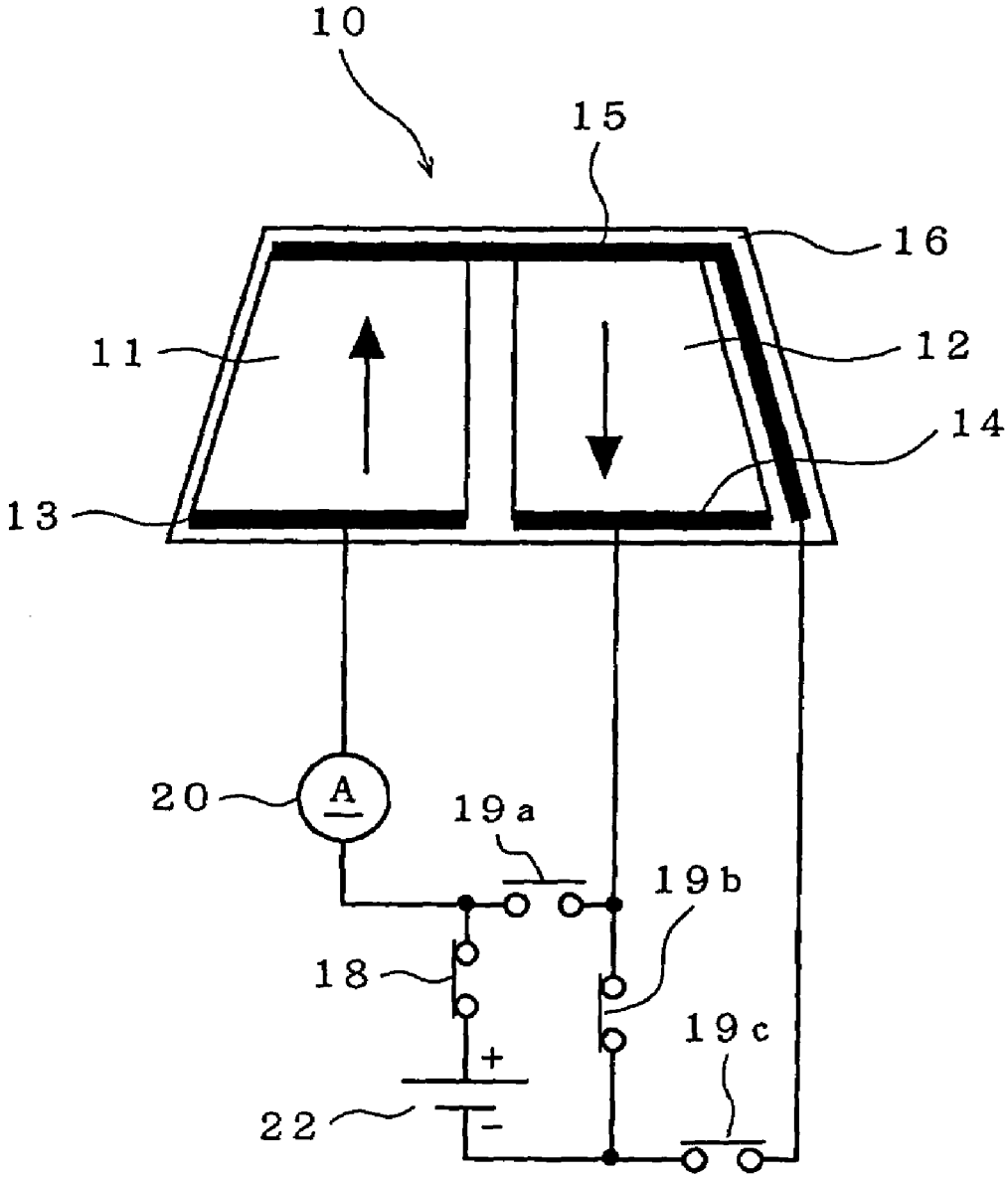
FIG. 2 is an explanatory view for showing another operation of the electrically heated windshield shown in FIG. 1.

Referring to FIG. 2, there is shown an explanatory view for showing another operation of an electrically heated windshield shown in FIG. 1.

In case of removing fog on the inside surface of the windshield 10, the relay contacts 18 and 19*b* are turned ON, and the relay contacts 19*a* and 19*c* are turned OFF as shown in FIG. 2. The bus bar 13 is caused to be + potential by turning ON the relay contacts 18, and the bus bar 14 is caused to be − potential by turning ON the relay contact 19*b*. Thus, a DC current flows from the bus bar 13 to the bus bar 14 via the bus bar 15 as shown by arrows to heat the heaters 11 and 12 in a series connected manner.

Because the heaters 11 and 12 are heated a series connected manner, the voltage supplied to the heater 11 and 12 is substantially one half that in FIG. 1, and the current flowing through the heater 11 and 12 is substantially one half that in FIG. 1, so that the calorific values due to the heaters 11 and 12 becomes one fourth that in FIG. 1, respectively.

As a result, the windshield 10 is heated by a calorific value which is substantially one fourth that in the case of removing ice and-frost adhered on the outside surface of the windshield. Therefore, fog on the inside surface of the windshield may be removed by a necessary and enough calorific value without necessitating larger calorific value for melting ice and the like.

Referring to FIG. 3, there is shown a table for showing the current supplied to the heaters and the electric power for removing frost by heating. As shown in the table, in order to select the electric power supplied respective heaters 11 and 12 to be 500 W, the voltage and current supplied to the heaters are 13V and 38.5 A, respectively. The electric power for removing frost is about 500.0 W at 13V, and about 426.0 W at 12V, and about 579.9 W at 14V. The electric power for removing fog is about one fourth the electric power described above, i.e., about 125.0 W at 13V, about 106.5 W at 12V, and about 145.0 W at 14V.

Figure 4:
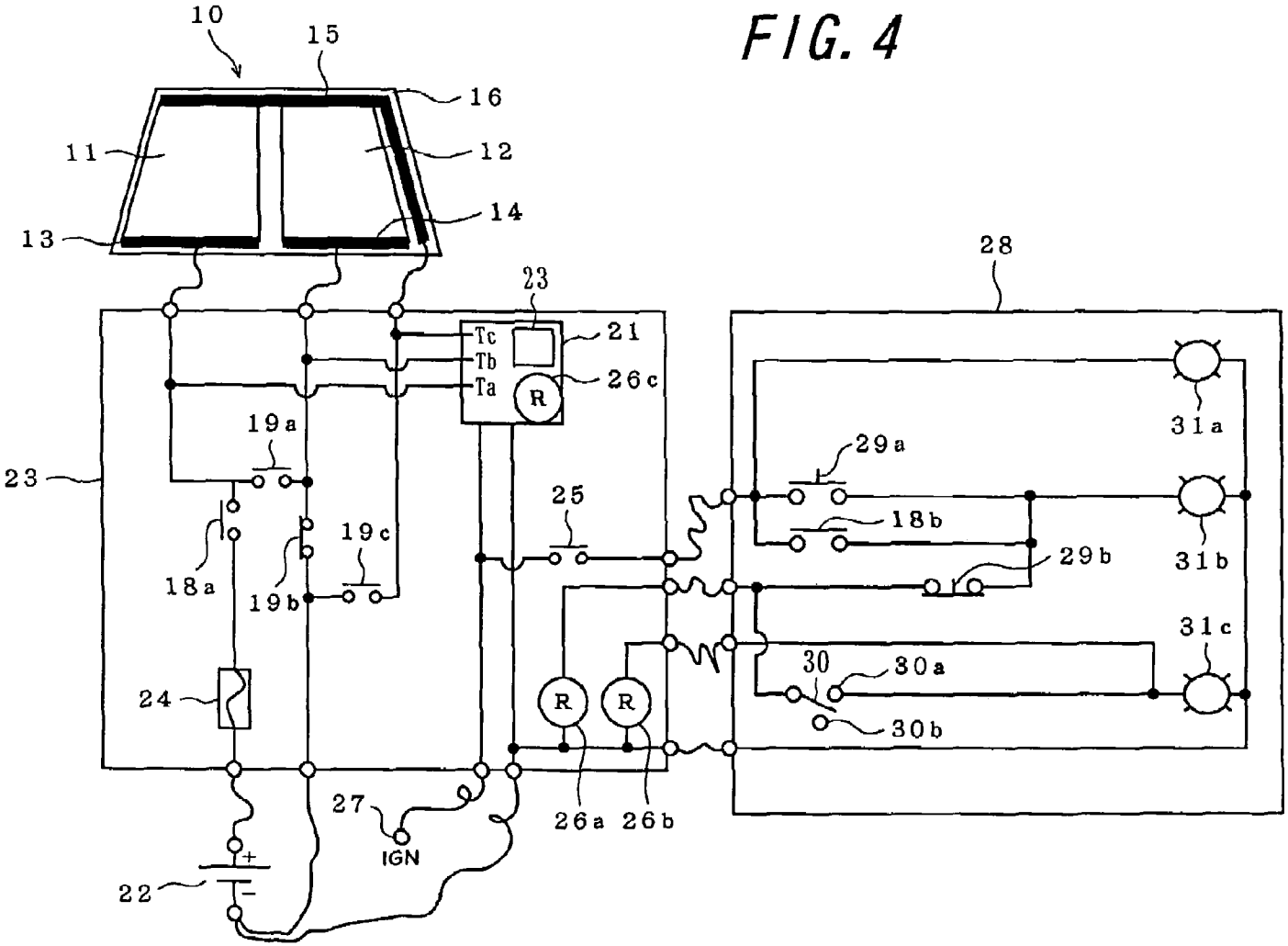
FIG. 4 is a figure showing one example of the electrically heated windshield, an operating circuit thereof, and a lamp controller circuit.

Referring to FIG. 4, there is shown a figure showing one example of the electrically heated windshield, an operating circuit thereof, and a lamp controller circuit. As shown in FIG. 4, the switching/detecting circuit 23 connected to the windshield 10 comprises a fuse 24 provided between the + terminal of the external DC power supply 22 and the relay contact 18*a*, a relay contact 25, and three relay drivers 26*a*, 26*b* and 26*c* each consisting of coils or the like in addition to the switching/detecting circuit 17 in FIG. 1 The relay driver 26C is provided in the controller box 21. A connecting terminal 27 to an ignitor (IGN) provided outside is connected to the relay contact 25 and the relay driver 26*c*, an ignition voltage being supplied to the terminal 27.

The relay driver 26*a* turns ON or OFF the relay contacts 18*a* and 18*b*, the relay driver 26*b* turns ON or OFF the relay contacts 19*a*, 19*b* and 19*c*, and the relay driver 26*c* turns ON or OFF the relay contact 25, respectively. The relay contacts 19*a* and 19*c* and the relay contact 19*b* are operative oppositely to each other, i.e., if the relay contacts 19*a* and 19*c* are turned ON, the relay contact 19*b* is turned OFF, and if the relay contacts 19*a* and 19*c* are turned OFF, then the relay contact 19*b* is tuned ON.

That is, the relay contacts 19*a* and 19*b* constitute a pair of relay contacts that are turned ON or OFF oppositely to each other to connect selectively between the bus bar 13 and the + or − terminal of the external DC power supply 22.

The controller circuit 28 is connected to the switching/detecting circuit 23. The controller circuit 28 comprises a heater ON switch 29*a* and heater OFF switch 29*b* which are operative by pushing operation, a relay contact 18*b*, a changeover switch 30 including a contact 30*a* for melting ice and a contact 30*b* for defogging, a power supply displaying lamp 31*a* for lighting white color, a heater displaying lamp 31*b* for lighting a red color LED (Light Emitting Diode), and an ice melting display lamp 31*c* for lighting a green color LED. The heater ON switch 29*a* is a normally OFF switch which is turned ON only when it is operating by pushing, and the heater OFF switch 29*b* is a normally ON switch which is turned OFF only when it is operating by pushing.

The operation of the switching/detecting circuit 23 and controller circuit 28, which operation is accompanied by the operation of the heaters 11 and 12 of the electrically heated windshield 10, will now described with reference to FIG. 4. The relay driver 26*c* turns ON the relay contact 25 when the ignition voltages become 13V or more. The condition such that the ignition voltage is equal to or larger 13V means that an engine of a vehicle is started.

When the ignition voltage becomes 13V or more to start an engine of a vehicle, the relay driver 26*c* turns ON the relay contact 25. When the relay contact 25 is turned ON, the ignition voltage is supplied to the power supply display lamp 31*a* to light the lamp 31*a* in white color.

For the case that ice, frost and the like adhered on the outside surface of the electrically heated windshield 10 are removed, the heater ON switch 29*a* is pushed and then the changeover switch 30 is switched to the contact 30*a* for melting ice. By pushing operation of the heater ON switch 29*a*, the ignition voltage is supplied to the heater display lamp 31*b* via the relay contact 25 turned ON and the heater ON switch 29*a* to light the red color LED as the hater display lamp 31*b*.

At the same time, the ignition voltage is supplied to the relay driver 26*a* via the heater ON switch 29*a* and heater OFF switch 29*b* to turn ON the relay contacts 18*a* and 18*b* together.

When the relay contact 18*b* is turned ON, the ignition voltage is supplied to the ice melting display lamp 31*c* and the relay driver 26*b* via the ice melting contact 30*a* of the changeover switch. When the ignition voltage is supplied to the ice melting display lamp 31*c*, the green color LED as the display lamp 31*c* is lit, and when the ignition voltage is supplied to the relay driver 26*b*, the relay driver 26*b* is operated to turn ON the relay contacts 19*a* and 19*c* and turn OFF the relay contact 19*b*.

Therefore, voltages are supplied between the bus bar 13 and the bus bar 15 and between bus bar 14 and the bus bar 15 from the external DC power supply 22, so that the heaters 11 and 12 are heated in a parallel connection manner. Thereby, ice and frost adhered on the outside surface of the windshield 10 are melted to be removed.

While the heater ON switch 29*a* is turned OFF immediately after pushing operation, an electric power is continued to be supplied to the heater display lamp 31*b*, the relay driver 26*a*, and the relay driver 26*b*.

For the case of defogging the inside surface of the windshield 10, the heater ON switch 29*a* is pushed and then the changeover switch 30 is switched to the contact 30*b* for defogging. By pushing operation of the heater ON switch 29*a*, the red color LED as the heater display lamp 31*b* is lit, and the relay driver 26*a* is operated to turn ON the relay contact 18*a* and 18*b*, whereas the relay driver 26*b* is not operated and the ice melting display lamp 31*c* is not lit, because the changeover switch is switched to the defogging contact 30*b*.

Therefore, the relay contacts 18*a* and 19*b* are turned ON together, so that voltages are supplied between the bus bar 13 and the bus bar 14 to heat the heaters 11 and 12 in a series connected manner. Thereby, the inside surface of the windshield 10 is defogged.

For the case of stopping the heating of the windshield 10, the heater OFF switch 29*b* is pushed, thereby the conducting path to the relay driver 26*a* is cut off to turn OFF the relay contacts 18*a* and 18*b* together. When the relay contact 18*a* is turned OFF, the feeding to the bus bars 13 and 14 from the external DC power supply 22 is stopped, so that the heaters 11 and 12 are not heated. Also, when the relay contact 18*b* is turned OFF, the heater display lamp 31*b* is lit out.

While the heater OFF switch 29*b* is turned ON immediately after pushing operation, the heater ON switch 29*a* and the relay contact 18*b* have been already turned OFF, so that an electric power is not supplied via the heater OFF switch 29*b*.

If each of bus bars 13, 14 and 15 has a heating function, the heating of the peripheral portions of the windshield may be possible in addition to the heating of the inner area of the windshield, resulting in a deicer function. The deicer function is to heat a windshield in order to prevent wiper blades from freezing to the windshield and to heat the wiper blades frozen to the windshield, which is useful in snowfall. The calorific value by the deicer function may be controlled by varying the width of the bus bar 15, i.e. the resistance thereof.

When the deicer function is used at an ice-melting mode in which ice and frost are removed, the producing of snow banks in snowfall may also be prevented because the bus bar 15 is extended to the side of the bus bar 14 which is positioned near a driver's seat as shown in FIG. 1. Upon operating wipers in snowfall, in the case that a driver's seat is on the right side (i.e., in the case of a vehicle having a steering wheel on the right side), snow wiped from the surface of the windshield is gathered to the right side of the windshield near a driver seat to produce snow bank. The snow bank thus produced may be melted and disappeared by heat generated by the bus bar 15.

In this case, snow bank may be disappeared more effectively by smaller consumed electric power, because the bus bar 15 is positioned on the right side of the windshield near a driver's seat, on which snow bank is produced by the movement of a wiper.

Figure 5:
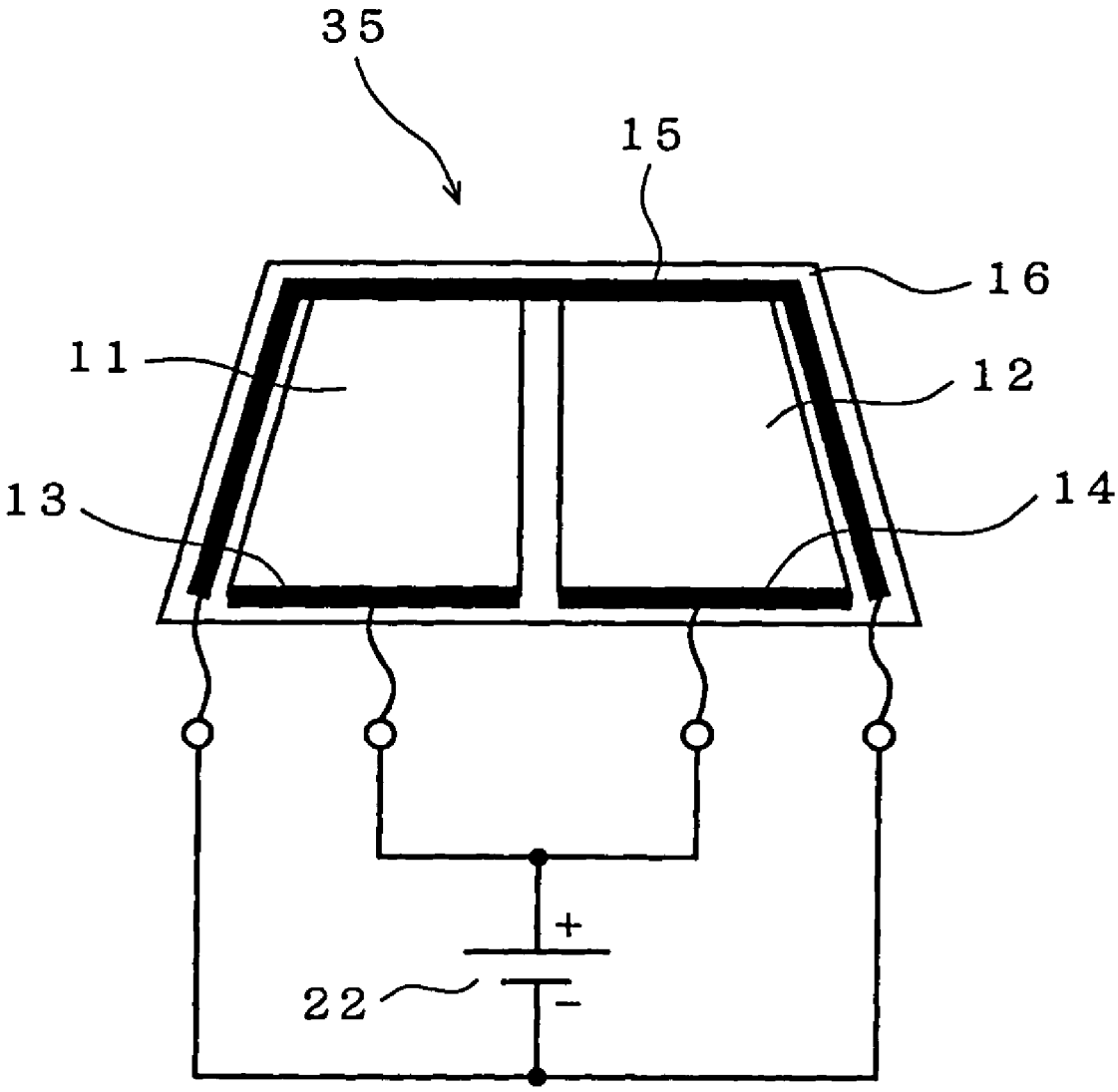
FIG. 5 is an explanatory view for showing another example of an electrically heated windshield.

Referring to FIG. 5, there is shown an explanatory view for showing another example of an electrically heated windshield. In an electrically heated windshield 35 shown in the figure, the bus bar 15 is also extended to the side of the bus bar 13, which is on the left side of the windshield near an assistant driver 's seat in a vehicle having a steering wheel on the right side. The windshield 35 has the same structure and operation as that in the windshield 10 except that the bus bar 15 is positioned on both sides of the windshield and an electric power is supplied to the both ends of the bus bar 15 from the external DC power supply 22.

According to the present invention described above, the heaters 11 and 12 are provided in an adhesive film of a windshield formed by laminating two glass panels, the heaters 11 and 12 dividing laterally the windshield into two parts, so that the heaters 11 and 12 are fed in a parallel or series connection manner. Two heaters 11 and 12 operate with their calorific values varied by changing feeding methods for the case of melting ice, frost and the like adhered on the outside surface of the windshield (outside a vehicle) or the case of defogging the inside surface of the windshield (inside a vehicle). The deicer function required in snowfall may be used in an ice-melting mode for melting ice, frost and the like.

The circuit for detecting the excessive heating of the windshield caused by the abnormal heating of the heaters 11 and 12 is provided in a controller box 21 having the terminals Ta, Tb and Tc connected to the bus bars 13, 14 and 15, respectively.

Because the three bus bars are provided for feeding the respective heaters 11 and 12, not only the calorific value may be varied, but also the breakage of a windshield may be detected. The bus bars also may have a deicer function since the bus bar is on a driver's seat side of a windshield.

Thereby, the consumed electric power may be varied with matching to the purpose of heating, so that the electric power load due to the use of heaters may be further decreased, resulting in a less percentage occupied to an electric power supplying capacity of a vehicle. In this manner, removing of ice on the outside surface of the windshield, snow bank on the end portion of a wiper moving area in snowfall, or fog on the inside surface thereof is effectively carried out to ensure a field of view in the windshield for a driver. The breakage of the windshield may be detected by sensing the feeding condition to the heaters 11 and 12, so that the dedicated terminals for detecting the excessive heating of the surface of the windshield by an abnormal operation of the heaters are not required.

While two heaters are provided in the embodiment described above in such a manner that they divide the windshield laterally into two parts, the number of heaters is not limited thereto, then three or more heaters may be provided. Also, the number of bus bars is not limited to three, then four or more bus bars may be provided.

INDUSTRIAL APPLICABILITY

According to the present invention, the consumed electric power may be varied with matching to the purpose of heating, so that the electric power load due to the use of heaters may be further decreased, resulting in a less percentage occupied to an electric power supplying capacity of a vehicle. Thereby, removing of ice on the outside surface of the windshield, snow bank on the end portion of a wiper moving area in snowfall, or fog on the inside surface thereof may be effectively carried out to ensure a field of view in the windshield for a driver. The breakage of the windshield may be detected by sensing the feeding condition to the heaters, so that the dedicated terminals for detecting the excessive heating of the surface of the windshield by an abnormal operation of the heaters are not required.

The invention claimed is:

1. An electrically heated window glass, comprising:

two glass panels laminated to each other;

a plurality of heaters sandwiched between the two glass panels for heating the glass panels, the heaters being positioned in such a manner that the heaters divide the surface of the laminated glass panels into plural parts;

a plurality bus bars each provided at the end portions of each of the plurality of heaters for feeding thereto;

a changeover means for switching the connection between selected one of the plurality of bus bars and a DC power supply to heat the plurality of heaters in a series connected manner or parallel connected manner; and a current detecting circuit for separately detecting a current through each of the plurality of bus bars to obtain a condition representing no breakage of the laminated two glass panels from resistances between bus bars based on detected current values to sense an excessive heating of the laminated glass panels.

2. An electrically heated window glass according to claim 1, wherein the plurality of heaters are heated in a parallel connected manner for the case of removing at least ice and frost adhered on the outside surface of the laminated glass panels, or the plurality of heaters are heated in a series connected manner for the case of removing fog on the inside surface of the laminated two glass panels, by switching the operation of the changeover means.

3. An electrically heated window glass according to claim 1, wherein each of the plurality of bus bars comprises a heating function to allow peripheral area of the laminated glass panels to be heated in addition to the heating of an inner area of the laminated glass panels.

4. An electrically heated window glass, comprising:

two class panels laminated to each other;

a plurality of heaters sandwiched between the two glass panels for heating the glass panels, the heaters being positioned in such a manner that the heaters divide the surface of the laminated glass panels into plural parts, wherein the plurality of heaters are two heaters positioned side by side in such a manner that the two heaters laterally divide the laminated glass panels into two parts;

a plurality bus bars each provided at the end portions of each of the plurality of heaters for feeding thereto, wherein the plurality of bus bars, each consisting of an electrical conductive strip, include a first and second bus bars provided at the lower edge of the two heaters, respectively, and a third bus bar provided at the upper edges of the two heaters and extended to the side of lower edge of one of the first and second bus bars along the side edge of one of the two heaters to connect the two heaters to each other; and a changeover means for switching the connection between selected one of the plurality of bus bars and a DC power supply to heat the plurality of heaters in a series connected manner or parallel connected manner.

5. An electrically heated window glass according to claim 4, wherein the changeover means includes, a relay for opening or closing between the first bus bar and the + terminal of the DC power supply, a pair of relays for connecting the second bus bar selectively to the + or − terminal of the DC power supply, the pair of relays operating oppositely to be opened or closed, and a relay for opening or closing between the third bus bar and the − terminal of the DC power supply.

6. An electrically heated window glass according to claim 1, wherein the laminated glass panels is a windshield of a vehicle.

7. An electrically heated window glass according to claim 4, wherein the laminated glass panels is a windshield of a vehicle.

8. An electrically heated window glass according to claim 5, wherein the laminated glass panels is a windshield of a vehicle.

* * * * *